US005807074A

United States Patent [19]

Fournier et al.

[11] Patent Number: 5,807,074

[45] Date of Patent: Sep. 15, 1998

[54] TURBINE NOZZLE DIAPHRAGM JOINT

[75] Inventors: Maurice D. Fournier, Clifton Park; Robert Hugh Johnson; George Reluzco, both of Schenectady; Robert Blair Wilson, Ballston Lake, all of N.Y.

[73] Assignee: General Electric Co., Schenectady, N.Y.

[21] Appl. No.: 784,500

[22] Filed: Jan. 17, 1997

Related U.S. Application Data

[63] Continuation of Ser. No. 572,189, Dec. 13, 1995, abandoned, which is a continuation of Ser. No. 383,136, Feb. 3, 1995, abandoned.

[51] Int. Cl.[6] ..... F04D 29/44

[52] U.S. Cl. ..... 415/209.3

[58] Field of Search ..... 415/209.1, 209.2, 415/209.3; 416/204 R, 208, 213

[56] References Cited

U.S. PATENT DOCUMENTS

| | | | |
|---|---|---|---|
| 1,213,930 | 1/1917 | Matten | 415/209.2 |
| 1,641,665 | 9/1927 | Devaud | 415/210.2 |
| 2,905,404 | 9/1959 | Hertl | 415/209.2 |
| 3,788,767 | 1/1974 | Bednarczyk et al. | 415/209.2 |

FOREIGN PATENT DOCUMENTS

| | | | |
|---|---|---|---|
| 61466 | 2/1961 | Canada | 415/210.1 |
| 143103 | 8/1983 | Japan | 415/210.1 |
| 63305 | 4/1984 | Japan | 415/210.1 |
| 865198 | 4/1961 | United Kingdom | 415/209.2 |

*Primary Examiner*—John T. Kwon
*Attorney, Agent, or Firm*—Nixon & Vanderhye

[57] ABSTRACT

The turbine nozzle diaphragm includes nozzle diaphragm segments formed of a subassembly including inner and outer spacer bands with airfoil-shaped partitions circumferentially spaced one from the other secured to the inner and outer spacer bands. Inner web and outer ring segments are secured to the inner and outer spacer band segments, respectively, to form nozzle diaphragm segment halves. End surfaces of the inner webs and outer rings lie in a plane passing through the axis of the nozzle diaphragm. The spacer bands have flanges projecting from the ends of the segments with weld material built up behind the flanges to provide additional support for the trailing edge portions of the partition adjacent the joint. Complementary recesses are formed in the opposed ends of the opposite segment whereby a Z-joint requiring limited material and labor is formed.

8 Claims, 3 Drawing Sheets

TURBINE NOZZLE DIAPHRAGM JOINT

This is a continuation of application Ser. No. 08/572,189, filed Dec. 13, 1995, which in turn is a continuation of application Ser. No. 08/383,136, filed Feb. 3, 1995, now abandoned.

TECHNICAL FIELD

The present invention relates to a turbine nozzle diaphragm and particularly to a novel and improved joint between nozzle diaphragm segments for improving performance and reducing labor and material costs in the fabrication of the nozzle diaphragm assembly.

BACKGROUND

There are currently a number of ways of forming the horizontal joint for a turbine nozzle diaphragm, for example, a steam turbine nozzle diaphragm. It will be appreciated that a turbine nozzle diaphragm is split essentially into two generally semi-annular segments joined to one another along horizontal joints. Each segment includes a number of circumferentially spaced airfoil-shaped partitions, the space between adjacent pairs of such partitions forming contoured nozzles (hereinafter referred to as "nozzles"). Three different types of horizontal joints have typically been used, each having its own advantages and disadvantages. One such joint is known as a split nozzle joint, wherein an airfoil-shaped partition at each joint is split in an axial direction such that a trailing portion of the partition is secured to the inner web and outer ring of one nozzle diaphragm segment, while its admission portion is secured to the inner web and outer ring of the adjacent nozzle diaphragm segment across the joint. Accurate and precise mating of the split partition portions at each of the joints is difficult and costly to achieve. Moreover, one or more support rods typically extend from an adjacent partition to the trailing edge portion of the split partition to provide structural support at least for the trailing edge portion of the split partition. This, however, degrades performance in the fluid flow, e.g., steam, path. That is, the nozzle defined in part by the split partition is disrupted by discontinuities in the airfoil shape of the partition and by the support rods between the split partition and an adjacent supporting partition.

In another joint design, a portion of a complete partition is secured to only one of the nozzle diaphragm segments and the remaining portion overhangs the adjacent segment. Particularly, the trailing edge portion of a partition at each joint is secured to one nozzle diaphragm segment while the admission portion of that partition overhangs the adjoining nozzle diaphragm segment. The overhanging admission portion is not welded to such other segment. Support for the overhanging admission portion of the partition is provided by one or more pins joining the overhanging admission portion and an adjacent partition. Thus, while the overhanging partition comprises a complete or whole partition in contrast to a split partition at the joint, the fluid flow remains disrupted by the support rods between the adjacent partitions thereby adversely affecting the performance of the nozzle. Additionally, the overhanging partition lacks structural strength and is typically limited to nozzle stages having a low pressure drop.

In a third nozzle diaphragm design, a whole air-foil-shaped partition is supported by a Z-joint formed across the entire radial extent of the nozzle diaphragm ring and web. That is, the end face of each of the inner web and outer ring, including the spacer bands, has a generally Z-shape in a radial direction to accommodate and support a whole partition. While undisturbed fluid flow and structural strength are provided by the whole nozzle Z-joint design, substantial labor and material costs are required because of the need to project the inner web and outer ring beyond the end faces of the joint.

While these nozzle diaphragm joint designs have been satisfactorily employed in the past, there is a trend toward employing fewer nozzles in nozzle diaphragms and using advanced aerodynamic nozzles. That is, for a given stage, current design trends provide fewer partitions and use advanced aerodynamic nozzle designs. Consequently, with fewer nozzle partitions, it is important to maximize the efficiency of the nozzle between adjacent partitions. With split and overhanging partition designs, the aerodynamic performance of the adjacent passages is adversely affected by the need for ancillary structural support, i.e., pins. With the total number of passages decreasing with the number of partitions, it becomes even more important that each passage have improved aerodynamic characteristics. The split and overhanging partitions with their ancillary supports degrade that nozzle performance. As indicated earlier, the whole nozzle design requires substantial material and labor costs in finishing the joint because of the need for the partitions to extend across the entire radial extent of the end faces of the inner web and outer ring.

DISCLOSURE OF THE INVENTION

In accordance with the present invention, there is provided a novel and improved turbine nozzle diaphragm joint which employs a whole airfoil-shaped partition and which does not involve the high material and labor costs of prior whole nozzle Z-joints. Thus, the present invention provides the benefits of a whole nozzle, i.e., no degradation of aerodynamic performance across the nozzle at the joint, while reducing the material and labor costs involved in the fabrication of the nozzle diaphragm segments. To accomplish this, each end face of the inner web and outer ring on one side of each nozzle diaphragm segment is formed essentially flat along a radial-axial plane, with the exception of a flange projecting from inner and outer spacer bands between the partitions, and a built-up structural support behind the flange. The flange is formed along the trailing edge of each spacer band and projects circumferentially in registry with the trailing edge portion of the partition adjacent the horizontal joint. Essentially, the projections comprised of the spacer band flange and structural support form Z-joints without using the inner web and outer ring. Thus, except for the built-up supports attached behind the flanges, the end faces of the inner web and outer ring lie in the radial plane. To afford structural strength, the structural support comprises weld material fused along the radial inner face of the projecting spacer band flange on the inner web and along the radial outer face of the projecting spacer band flange of the outer ring. The weld material is also fused to the end faces of the inner web and outer ring in those localized areas. The end faces of the inner web and outer ring opposing the projections lie along a radial plane containing the axis of the nozzle diaphragm and have complementary-shaped recesses for receiving the projections. By forming the joints in this manner, the material of the inner web and outer ring which otherwise would be necessary to form a complete whole nozzle Z-joint is entirely eliminated. Advantageously, those portions of the end faces of the inner web and outer ring, with the exception of the associated spacer bands, can be formed in a radial plane and therefore readily and easily finished prior to assembly.

To form the improved joint for a turbine nozzle diaphragm according to the present invention, the spacer bands are precisely cut to form openings for receiving the opposite ends of the partitions. The spacer bands are also originally formed with the projecting flanges and complementary recesses at their opposite ends. By securing, for example, by welding, the ends of the partitions to the spacer bands, a spacer band-partition subassembly is formed which can thereafter be welded to the inner web and outer ring. The inner web and outer ring segments are formed with end surfaces substantially lying in radial planes. Complementary recesses are formed in the end faces which will lie in opposition to the end faces bearing the projections of the opposing segment. Consequently, when the inner web and outer ring are welded to the spacer bands, portions of the end faces of the spacer bands are aligned with end faces of the inner web and outer ring, while the flanges thereof extend beyond those end faces. For structural strength, weld material is applied along the radial inner face of the spacer band flange of the inner web and along the radial outer face of the spacer band flange of the outer ring to complete the projections. The nozzle diaphragm segments may be assembled using a conventional bolting system. As a consequence of this construction, the partitions on opposite sides of the joint are whole partitions, not split and do not require ancillary structural support. The material and labor costs are also substantially reduced.

In a preferred embodiment according to the present invention, there is provided a nozzle diaphragm for a turbine comprising an outer ring, an inner web radially inwardly of the outer ring and a plurality of airfoil-shaped partitions between the outer ring and the inner web at circumferentially spaced positions about the nozzle diaphragm for forming a fluid path (nozzle) between the partitions and between the outer ring and the inner web, the outer ring and inner web lying about a common axis, the outer ring and the inner web being split to form at least a pair of nozzle diaphragm segments each having opposed, generally complementary, end faces forming respective joints with one another. One of the end faces on one segment includes a circumferentially extending projection and an opposed end face of another segment has a recess generally complementary in shape to the projection.

In a further preferred embodiment according to the present invention, there is provided a nozzle diaphragm for a turbine comprising an outer ring, an inner web radially inwardly of the outer ring and a plurality of airfoil-shaped partitions between the outer ring and the inner web at circumferentially spaced positions about the nozzle diaphragm for forming a nozzle between adjacent partitions and between the outer ring and the inner web, the outer ring and the inner web lying about a common axis. Spacer bands are secured to the outer ring and inner web and form the radially outer and inner surfaces respectively for the fluid path, the nozzle diaphragm being split into circumferentially extending segments, with each segment having end faces along the outer ring and inner web portions, respectively, in opposition to respective end faces along outer ring and the inner web portions of another segment. The spacer bands of the outer ring portion and the spacer band of the inner web portion of one segment each have an end flange projecting circumferentially beyond the corresponding end face, the spacer band of the outer ring portion and spacer band of the inner web portion of another segment each having a recess for receiving an opposed flange of the one segment upon assembly of the segments.

Accordingly, it is a primary object of the present invention to provide a novel and improved turbine nozzle diaphragm joint having improved aerodynamic performance and reduced labor and material costs.

BEST MODE FOR CARRYING OUT THE INVENTION

Figure 1:
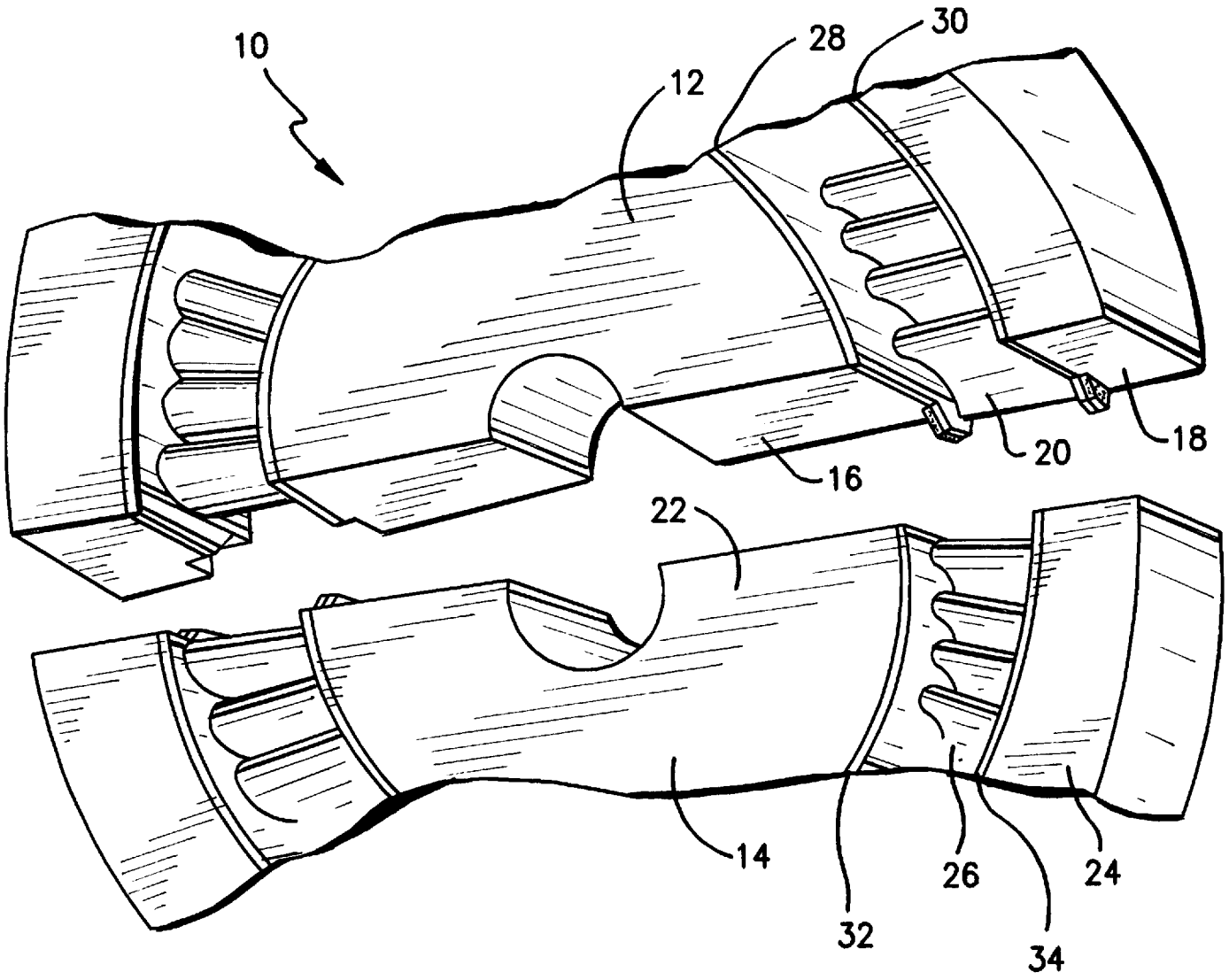
FIG. 1 is a fragmentary perspective view of a turbine nozzle diaphragm illustrating the horizontal joints between a pair of turbine nozzle diaphragm segments.

Referring now to the drawings, particularly to FIG. 1, there is illustrated a turbine nozzle diaphragm, generally designated 10, comprised of a pair of nozzle diaphragm segments 12 and 14. Segment 12 includes an annular inner web 16, an outer ring 18 and airfoil-shaped partitions 20 circumferentially spaced one from the other about the segment. Segment 14 includes an annual inner web 22, an outer ring 24 and airfoil-shaped partitions 26 spaced circumferentially one from the other about the segment. Segment 12 also includes a spacer band 28 secured to the inner web 16 and a spacer band 30 secured to the outer ring 18. Segment 14 includes a spacer band 32 secured to inner web 22 and a spacer band 34 secured to outer ring 24. It will be appreciated that, as illustrated, the turbine nozzle diaphragm includes nozzle diaphragm segment halves which are joined one to the other along a horizontal joint.

Figure 2:
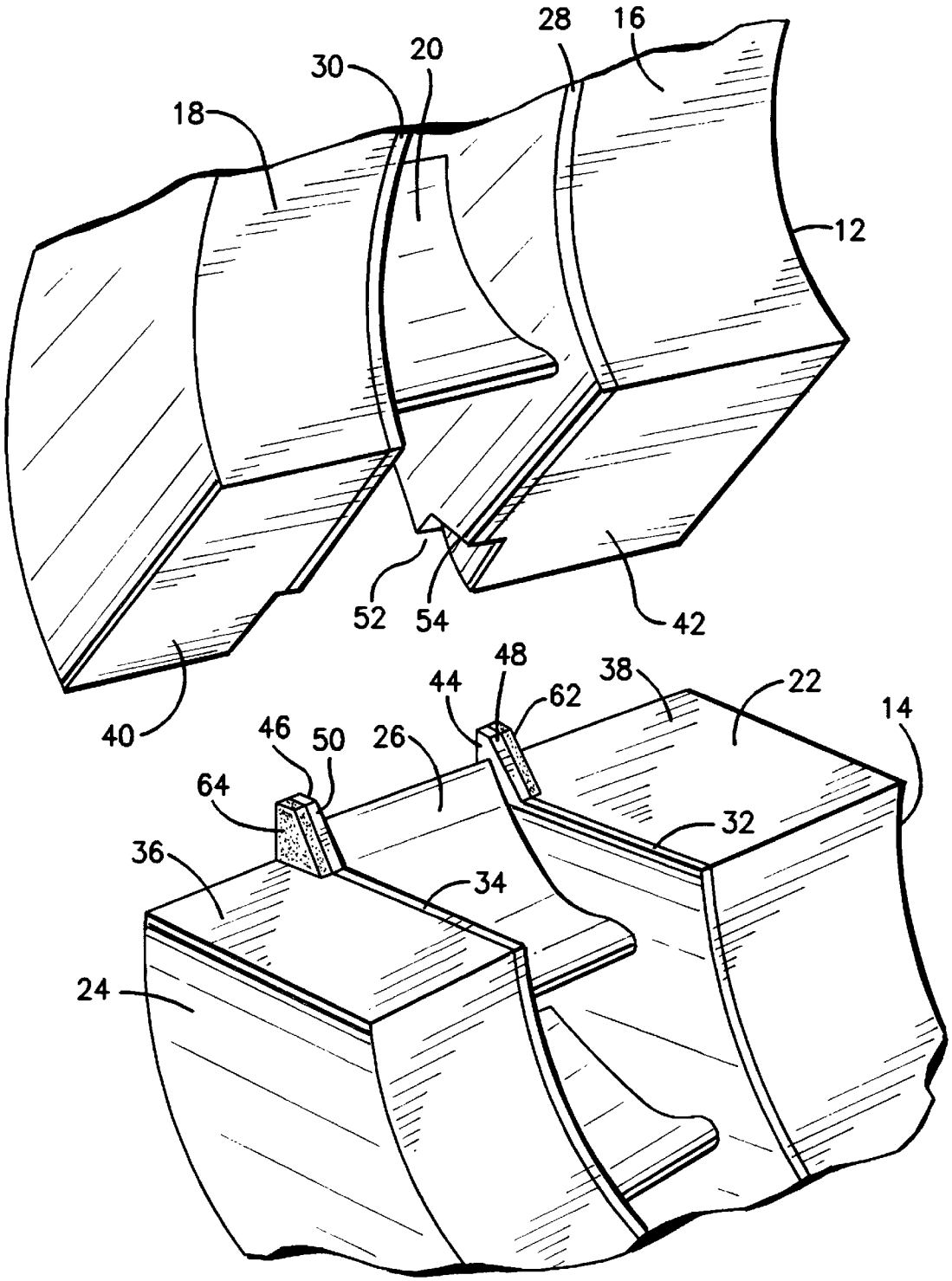
FIG. 2 is an enlarged perspective view of the end faces at a horizontal joint of the nozzle diaphragm segments with one segment canted relative to the other for illustrative purposes only.
Figure 3A:
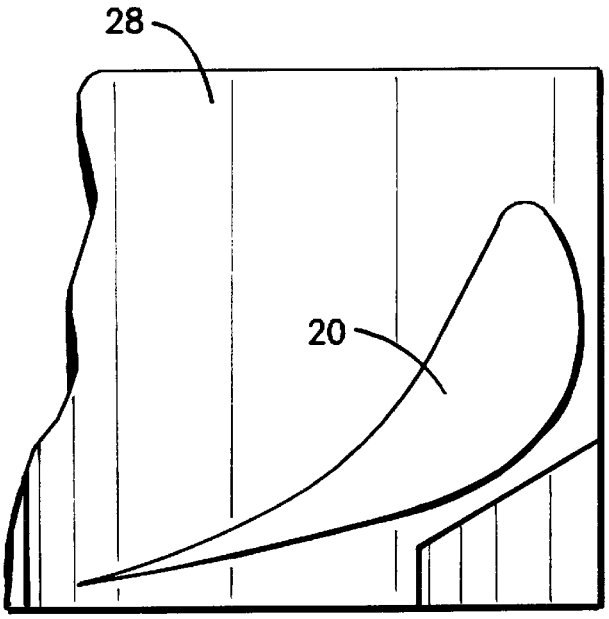
FIGS. 3A and 3B are fragmentary radial and circumferential views, respectively, of one of the end faces illustrating the complementary recess for a projection of an opposed end face.
Figure 3B:
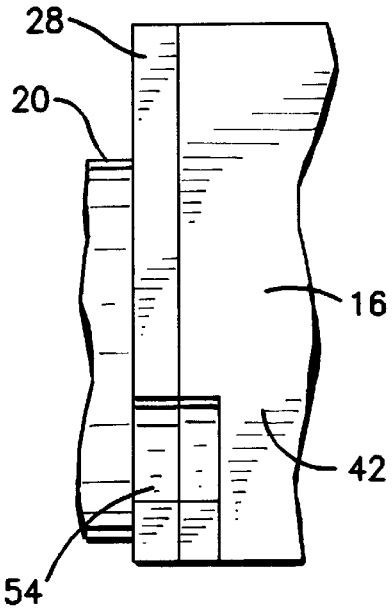
Figure 4A:
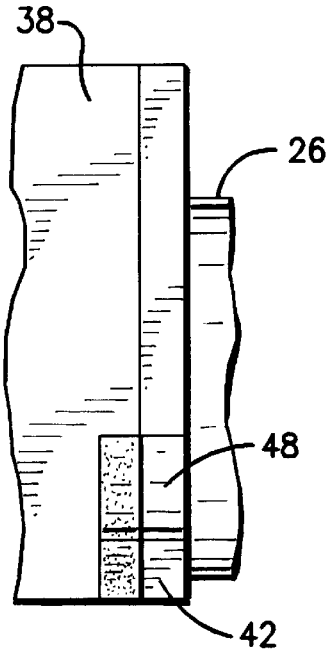
FIGS. 4A and 4B are circumferential and radial views, respectively, illustrating a projection on the opposed end face.
Figure 4B:
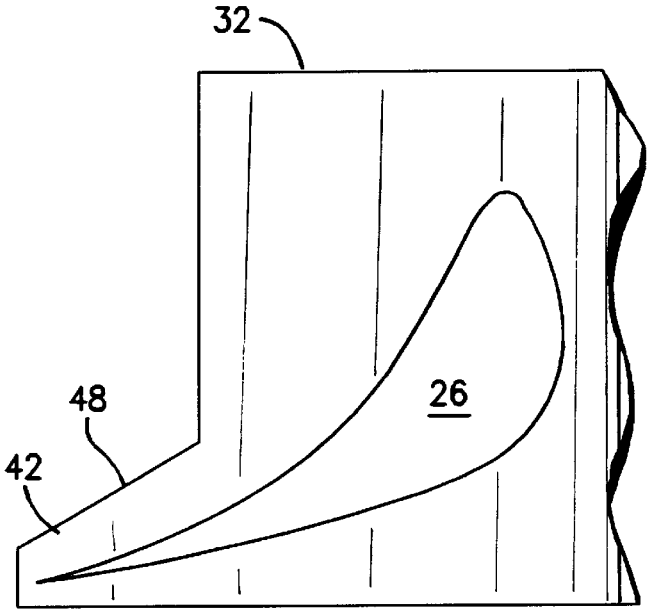

FIG. 2 discloses a horizontal joint along one side of the nozzle diaphragm 10. As illustrated, the end faces 36 and 38 of the outer ring 24 and inner web 22, respectively, of segment 14 lie along a radial plane passing through and containing the axis of the nozzle diaphragm. Similarly, the end faces 40 and 42 of the outer ring 18 and inner web 16, respectively, of the opposed segment 12 lie essentially along the same radial plane when the joint is completely formed. From a review of FIG. 2, it will be appreciated that the end faces 36, 38, 40 and 42 are substantially planar over the entire end surface. Consequently, the end faces of the inner web and outer ring of each segment are readily and easily fabricated and finished.

As illustrated, the spacer bands 32 and 34 have end faces terminating flush with the corresponding end faces of the inner web and outer ring, respectively, with the exception of a flange. For example, flange 44 projects in a circumferential direction from the end face of spacer band 32, while a flange 46 projects in a circumferential direction from the end face of spacer band 34. Preferably, the projections 44 and 46 lie along trailing edge portions of the airfoil-shaped partition 26 at the joint between the segments such that the airfoil-shaped partition adjacent to the joint comprises a whole airfoil secured to the spacer bands 32 and 34 and which is wholly supported at its opposite ends. The projections 44 and 46 have inclined surfaces 48 and 50, respectively, projecting in a circumferential and axial downstream direction. It will be appreciated that, while the end faces of the joint along one end of segment 14 have been described, the end faces of the joint along the opposite end of the opposed segment 12 is of like configuration.

The spacer bands 28 and 30 of the adjoining nozzle diaphragm segment have complementary recesses in their end faces. Consequently, each recess 52 has an angled face 54 complementary to the angled faces 48 and 50 of projections 44 and 46. To provide additional structural support for the trailing edge of the partition at the horizontal joint in addition to that provided by the flanges 44 and 46, weld material is built up on the side of the projections away from the partition. Thus, weld material 62 is built up along the radially inner face of projection 44 and fused to the end face 38 of inner web 22. Weld material 64 is also built up along the radially outer side of projection 50 and fused to the end face 36 of outer web 24. The opposing end faces 42 and 40 of the inner web 16 and outer ring 18, respectively, of the adjoining segment 12 are similarly recessed in a complementary manner to accommodate the built-up weld material. While the end faces of the joint along one end of segment 12 have been described, the end faces of the joint along the opposite end of the opposed segment 14 is of like configuration. Thus, it will be appreciated that the opposite ends of each segment half are provided with projections and recesses, respectively, for complementary engagement with opposite ends of the opposed segment.

To fabricate the nozzle diaphragm assembly, the spacer bands and partitions are first formed into a subassembly. The spacer bands are provided with circumferentially spaced openings to receive the ends of the airfoil-shaped partitions. The ends of the spacer bands are also provided with the flanges 44 and 46 as well as the recesses 52 at their opposite ends. The partitions are then welded in the spacer band openings to form a spacer band-partition subassembly of generally semi-annular configuration. The inner webs and outer rings are then applied, by welding, to the two subassemblies, respectively. The built-up weld material is applied to the appropriate surfaces of the flanges as previously described to provide additional structural support for the trailing edge portions of the partitions adjacent the horizontal joints. The nozzle diaphragm segments are then mated to form the nozzle diaphragm with the projections including the flanges and built-up weld material at each horizontal joint being received in the corresponding complementary recesses of the opposed end of the opposite segment, thus completing the nozzle diaphragm joint assembly. The segments may be secured to one another in a conventional manner, for example, by bolts.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle diaphragm for a turbine comprising:

an outer ring, an annular inner web radially inwardly of said outer ring and a plurality of partitions between said outer ring and said inner web at circumferentially spaced positions for forming a fluid path between said partitions and between said outer ring and said inner web, said outer ring and inner web lying about a common axis;

outer ring and said inner web being split to form at least a pair of nozzle diaphragm segments each having opposed, generally complementary, end faces forming respective joints with one another;

one of said end faces on one segment including a circumferentially extending projection;

an opposed end face of another segment having a recess generally complementary in shape to said projection;

said one segment including a spacer band secured to one of said outer ring and said inner web, said projection comprising a portion of said spacer band;

weld material built up along a radial side of said spacer band projection portion for reinforcing said projection;

said partitions having trailing edge portions, said projection and said complementary recess lying in radial registration with one of said trailing edge portions.

2. A nozzle diaphragm according to claim 1 wherein said projection has an inclined face extending in an axial direction, said recess having a complementary-shaped wall for receiving the inclined face of said projection.

3. A nozzle diaphragm according to claim 1 wherein said segments have axially leading and trailing edge portions, said projection lying solely along said trailing edge portion of said one segment and said recess lying solely along said trailing edge portion of said another segment.

4. A nozzle diaphragm for a turbine comprising:

an outer ring, an annular inner web radially inwardly of said outer ring and a plurality of partitions between said outer ring and said inner web at circumferentially spaced positions about said nozzle diaphragm for forming a fluid path between said partitions and between said outer ring and said inner web, said outer ring and said inner web lying about a common axis;

spacer bands attached to said outer ring and said inner web spaced radially from one another forming radially inner and outer surfaces respectively for the fluid path;

said nozzle diaphragm being split into circumferentially extending segments, with each segment having end faces along outer ring and inner web portions, respectively, in opposition to respective end faces along outer ring and the inner web portions of another segment;

the spacer band of the outer ring portion and the spacer band of the inner web portion of one segment each having an end flange projecting circumferentially beyond the corresponding end face, the spacer band of the outer ring portion and spacer band of the inner web portion of said another segment each having a recess for receiving an opposed flange of said one segment upon assembly of said segments;

said partitions having admission and exit portions, said flanges lying in radial registration with exit portions of said partitions.

5. A nozzle diaphragm according to claim 4 including weld material built up along a radial outer side of the flange of said outer ring and along its end face for reinforcing said flange, and weld material built up along a radial inner side of the flange of said inner web and along its end face for reinforcing said flange.

6. A nozzle diaphragm according to claim 4 wherein said recesses are generally complementary in shape to said flanges, respectively.

7. A nozzle diaphragm according to claim 4 including weld material built up along a radial outer side of the flange of said outer ring and along its end face for reinforcing said flange, and weld material built up along a radial inner side of the flange of said inner web and along its web face for reinforcing said flange, said flanges and built-up web material forming projections from an end of said one segment, said recesses of said another segment being generally complementary in shape to said projections.

8. A nozzle diaphragm according to claim 4 wherein said segments have axially leading and trailing edge portions, said flange lying solely along said trailing edge portion of said one segment and said recess lying solely along said trailing edge portion of said another segment.

* * * * *